US010877423B2

(12) United States Patent
Kai

(10) Patent No.: US 10,877,423 B2
(45) Date of Patent: Dec. 29, 2020

(54) IMAGE FORMING APPARATUS THAT REPLENISHES TONER TO DEVELOPING DEVICE VIA HOPPER, AND METHOD OF CONTROLLING SAME

(71) Applicant: CANON KABUSHIKI KAISHA, Tokyo (JP)

(72) Inventor: Teruhito Kai, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/725,633

(22) Filed: Dec. 23, 2019

(65) Prior Publication Data

US 2020/0218190 A1 Jul. 9, 2020

(30) Foreign Application Priority Data

Jan. 9, 2019 (JP) ..... 2019-002017

(51) Int. Cl.
*G03G 15/00* (2006.01)

(52) U.S. Cl.
CPC ..... *G03G 15/556* (2013.01)

(58) Field of Classification Search
CPC ..... G03G 15/556; G03G 15/0849; G03G 15/0865; G03G 15/0877; G03G 15/0879
See application file for complete search history.

(56) References Cited

U.S. PATENT DOCUMENTS

2001/0017991 A1* 8/2001 Kobayashi ..... G03G 15/0889 399/61
2011/0170890 A1* 7/2011 Sakatani ..... G03G 15/0853 399/62
2015/0117880 A1* 4/2015 Okada ..... G03G 15/0856 399/30
2017/0139365 A1* 5/2017 Ootsuka ..... G03G 15/0867

FOREIGN PATENT DOCUMENTS

JP 2006220960 A 8/2006

* cited by examiner

*Primary Examiner* — Sandra Brase
(74) *Attorney, Agent, or Firm* — Rossi, Kimms & McDowell LLP

(57) ABSTRACT

A screw is rotated to replenish toner from a hopper to a developing device. Rotation of the screw, toner stored in the hopper, and a toner density in the developing device are detected. Whether or not to replenish toner from the hopper to the developing device is controlled based on a detection result of rotation of the screw. The number of rotations of the screw during a predetermined time period is acquired. The predetermined time period corresponds to a time period during which the replenishment processing is being executed and over which a state in which toner in the hopper is detected is changed to a state in which toner in the hopper is not detected. An abnormality of the hopper is detected if the number of rotations in the predetermined time period is larger than a predetermined number.

6 Claims, 12 Drawing Sheets

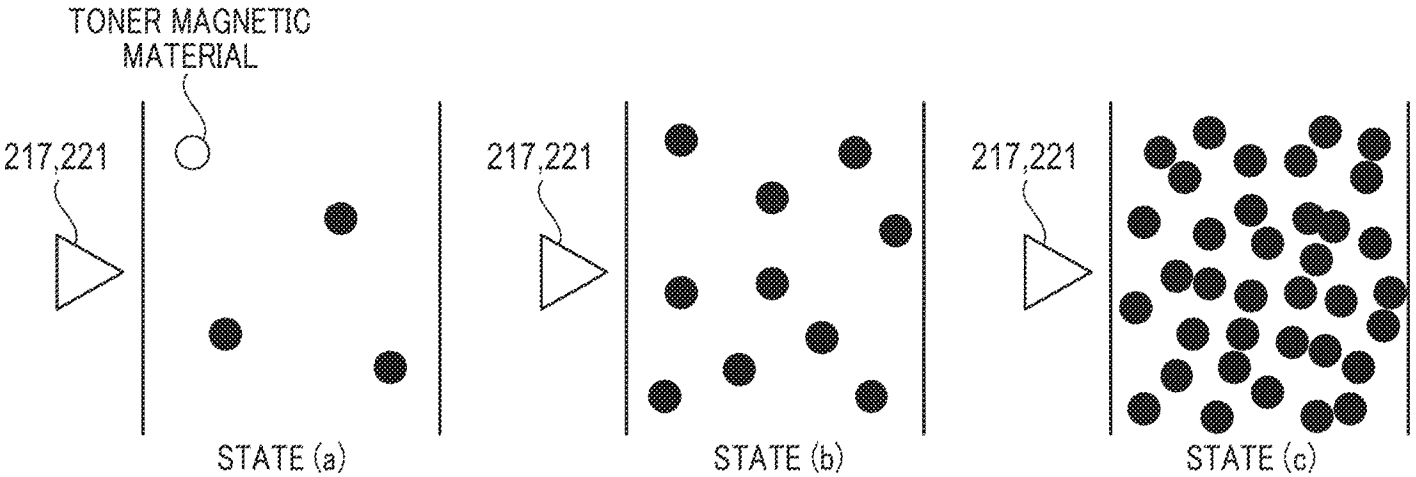
FIG. 5A
FIG. 5B
FIG. 5C
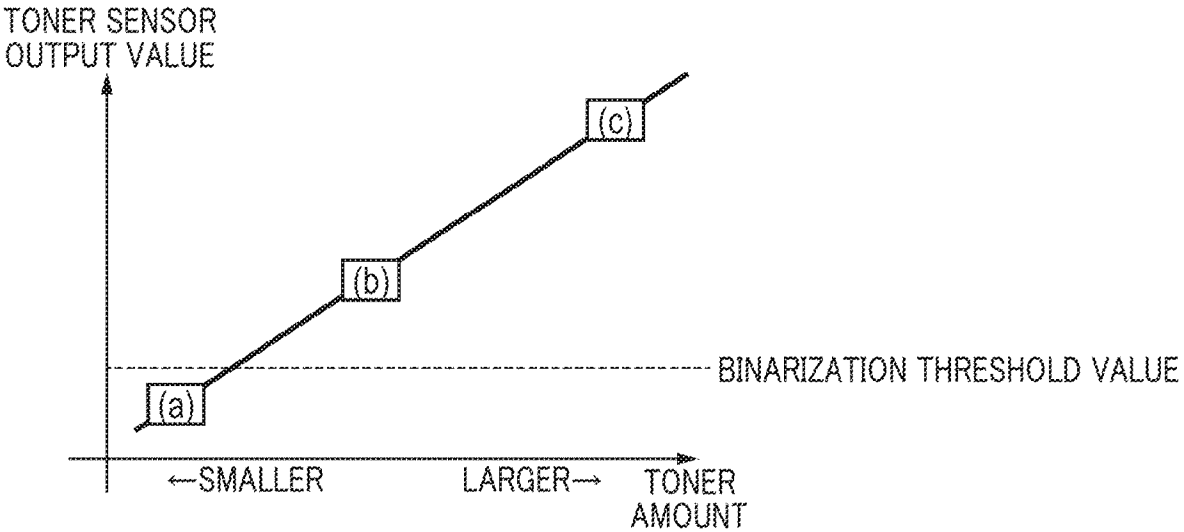
FIG. 5D

FIG. 11A

Abnormality has occurred.
(Contact Service Person in Charge)

Abnormality Code: AAAA
Abnormal Spot: developing device

FIG. 11B

Abnormality has occurred.
(Contact Service Person in Charge)

Abnormality Code: AAAA
Abnormal Spot: hopper

IMAGE FORMING APPARATUS THAT REPLENISHES TONER TO DEVELOPING DEVICE VIA HOPPER, AND METHOD OF CONTROLLING SAME

BACKGROUND OF THE INVENTION

Field of the Invention

The present invention relates to an image forming apparatus that replenishes toner in a toner container to a developing device via a hopper, and a method of controlling the same.

Description of the Related Art

Conventionally, image forming apparatuses of an electrophotographic type, an electrostatic recording type, and so forth include a known one that replenishes toner in a toner container to a developing device via a container (referred to as the hopper). The image forming apparatus of this type generally uses a sensor for detecting a toner density in the developing device, and provides, in a case where the toner density in the developing device is not higher than a predetermined value, an abnormality message notification, and terminates the image forming operation. There are various kinds of causes as reasons for the determination that the toner density in the developing device is lowered. For example, the causes include not only an abnormality of the sensor for detecting the toner density, and an abnormal toner sweeping operation in the image forming operation, but also failure of toner supply from the hopper to the developing device, etc. Particularly, in a case where the failure of toner supply to the developing device occurs, it is desirable, since the developing device has no abnormality, to correctly identify a true abnormal spot instead of prompting a user to replace the developing device.

An image forming apparatus disclosed in Japanese Laid-Open Patent Publication (Kokai) No. 2006-220960 proposes a method of detecting a conveyance abnormality occurring in a hopper (toner supply section) for supplying toner to a developing device. In a case where a toner density abnormality in the developing device has occurred, this apparatus performs toner replenishment from the hopper to the developing device for a predetermined time period to detect an abnormal spot. If there is no conveyance abnormality in the hopper, due to the toner replenishing operation to the developing device, eventually, the hopper runs out of toner and also the toner density in the developing device increases. For this reason, in a case where when toner replenishment to the developing device has been performed for the predetermined time period, if no increase in toner density in the developing device is detected in a state in which a toner presence/absence detection sensor in the hopper has detected presence of toner, the image forming apparatus disclosed in Japanese Laid-Open Patent Publication (Kokai) No. 2006-220960 determines that a toner conveyance abnormality has occurred in the hopper. With this, it is possible to correctly identify the abnormal spot in a case where the hopper is responsible for the toner density abnormality in the developing device.

The image forming apparatus disclosed in Japanese Laid-Open Patent Publication (Kokai) No. 2006-220960 uses a result of detection of toner density in the developing device to determine a conveyance abnormality in the hopper. However, toner in the developing device is intermittently consumed when a print job is executed, and hence the amount of toner consumed for image formation and the amount of toner replenished for the determination operation are offset. Therefore, there is a fear that it is impossible to correctly perform abnormality determination, such as determination of whether or not there is a possibility that toner is not conveyed from the hopper to the developing device. To avoid such an erroneous determination, it is possible to envisage performing control such that the abnormality determination operation is executed by temporarily stopping a print job. However, in this control, downtime of the print operation increases.

Further, there is a case where a toner conveying path from the hopper to the developing device is clogged with toner and toner is conveyed only little by little. In such a case, the toner density in the developing device is slightly increased by the toner replenishing operation, and hence there is a fear that it is impossible to correctly perform abnormality determination, including determination of a possibility that toner is not properly conveyed from the hopper to the developing device.

SUMMARY OF THE INVENTION

The present invention provides an image forming apparatus capable of accurately determining whether or not there is a possibility that toner is not properly conveyed from a hopper to a developing unit even when a print job is being executed, and a method of controlling the same.

In a first aspect of the present invention, there is provided an image forming apparatus comprising a photosensitive member, an exposure unit configured to expose the photosensitive member to form an electrostatic latent image, a developing unit configured to develop the electrostatic latent image formed on the photosensitive member with toner, a hopper in which the toner is stored, a rotational member that is rotated to replenish the toner from the hopper to the developing unit, a first sensor configured to detect rotation of the rotational member, a second sensor configured to detect toner stored in the hopper, a third sensor configured to detect a density of the toner in the developing unit, and a controller configured to control whether or not to execute replenishment processing for replenishing the toner from the hopper to the developing unit, based on a detection result of the third sensor, wherein the rotational member is driven for rotation in the replenishment processing; acquire the number of rotations of the rotational member during a predetermined time period based on a detection result of the first sensor, wherein the predetermined time period corresponds to a time period during which the replenishment processing is being executed and also over which a first state in which the toner in the hopper is detected by the second sensor is changed to a second state in which the toner in the hopper is not detected by the second sensor; and detect an abnormality of the hopper if the number of rotations in the predetermined time period is larger than a predetermined number.

In a second aspect of the present invention, there is provided a method of controlling an image forming apparatus including a photosensitive member, an exposure unit configured to expose the photosensitive member to form an electrostatic latent image, a developing unit configured to develop the electrostatic latent image formed on the photosensitive member with toner, a hopper in which the toner is stored, a rotational member that is rotated to replenish the toner from the hopper to the developing unit, a first sensor configured to detect rotation of the rotational member, a second sensor configured to detect toner stored in the hopper, and a third sensor configured to detect a density of the toner in the developing unit, the method comprising controlling whether or not to execute replenishment processing for replenishing the toner from the hopper to the developing unit, based on a detection result of the third sensor, wherein the rotational member is driven for rotation in the replenishment processing, acquiring the number of rotations of the rotational member during a predetermined time period based on a detection result of the first sensor, wherein the predetermined time period corresponds to a time period during which the replenishment processing is being executed and also over which a first state in which the toner in the hopper is detected by the second sensor is changed to a second state in which the toner in the hopper is not detected by the second sensor, and detecting an abnormality of the hopper if the number of rotations in the predetermined time period is larger than a predetermined number.

According to the present invention, it is possible to accurately determine whether or not there is a possibility that toner is not properly conveyed from the hopper to the developing unit even when a print job is being executed.

Further features of the present invention will become apparent from the following description of exemplary embodiments (with reference to the attached drawings).

BRIEF DESCRIPTION OF THE DRAWINGS

FIGS. 5A to 5D are conceptual views showing states of detection of toner in a toner conveying path and a developing device, and a diagram showing a relationship between the sensor output value and the amount of toner.

FIGS. 11A and 11B are diagrams each showing an example of display of an abnormality notification.

DESCRIPTION OF THE EMBODIMENTS

The present invention will now be described in detail below with reference to the accompanying drawings showing embodiments thereof.

Figure 1:
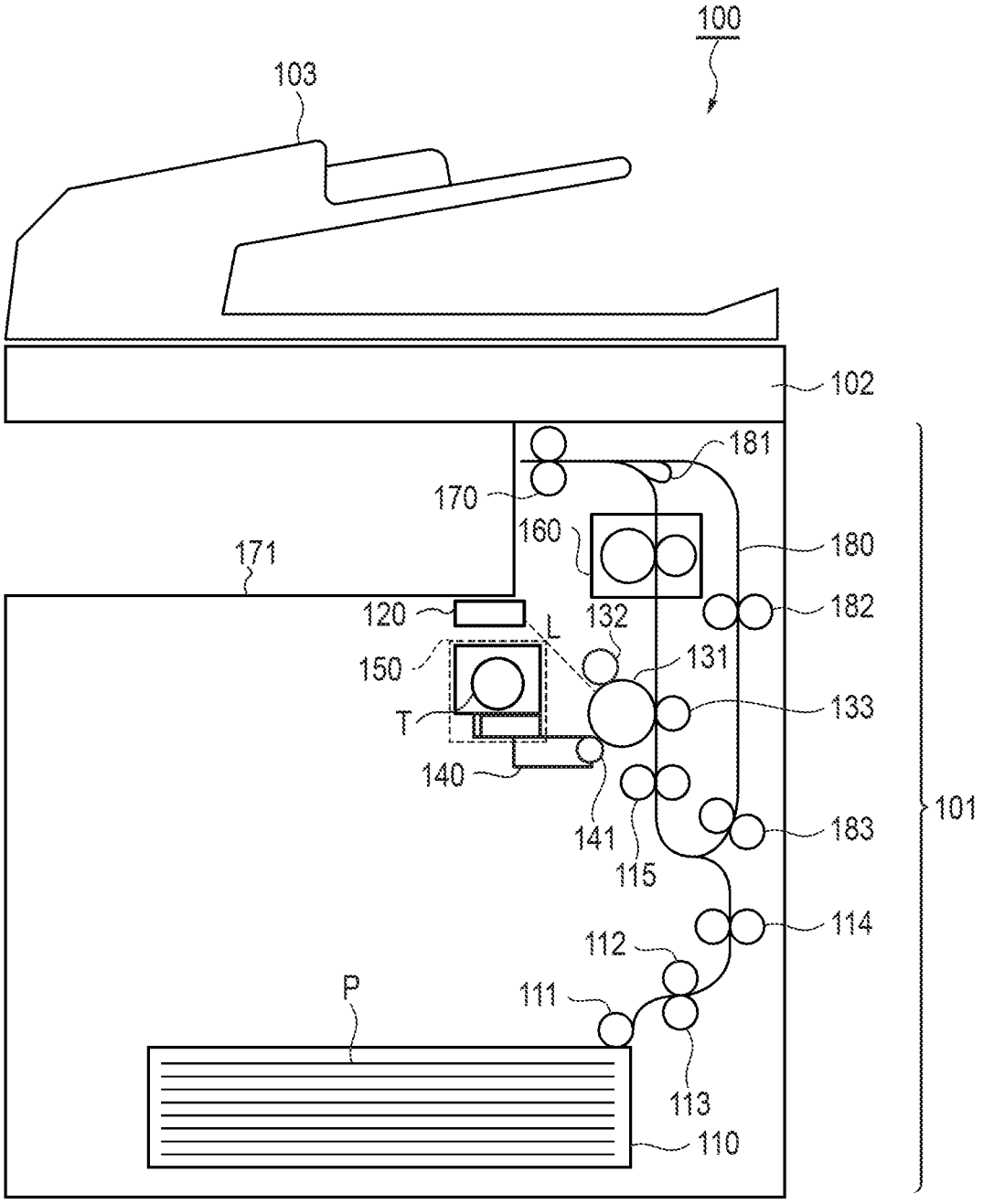
FIG. 1 is a schematic cross-sectional view of an image forming apparatus.

FIG. 1 is a schematic cross-sectional view of an image forming apparatus according to an embodiment of the present invention. This image forming apparatus, denoted by reference numeral 100, includes a printer unit 101 that performs image formation on a sheet, a reader unit 102 that reads an image of an original, and an ADF unit 103 that conveys an original to be read. Note that the sheet may be referred to as a recording sheet, a recording material, a recording medium, paper, a transfer material, a transfer sheet, and the like.

In the printer unit 101, recording sheets P, stored in a sheet feed cassette 110, are fed to a conveying path by a pickup roller 111, a sheet feeding roller 112, and a retard roller 113, one by one. Each recording sheet P fed from the sheet feed cassette 110 is conveyed along the conveying path by a sheet feeder conveying roller 114. When the recording sheet P has reached a position of a registration roller pair 115, skew of the sheet P is corrected by the registration roller pair 115 at rest. After that, the registration roller pair 115 starts to rotate to thereby convey the recording sheet P to a transfer nip between a photosensitive drum (photosensitive member) 131 and a transfer roller 133.

The printer unit 101 has an image forming section that forms an image on a recording sheet P, and the image forming section is comprised of a laser scanner unit 120, the photosensitive drum 131, a charge roller 132, the transfer roller 133, and a developing device 140. In the image forming section, an outer peripheral surface of the photosensitive drum 131, which is driven for rotation, is uniformly charged to a potential of a predetermined polarity by action of the charge roller 132. The laser scanner unit 120 is an exposure unit configured to expose the charged photosensitive drum 131 with a light beam (laser light). More specifically, the laser scanner unit 120 outputs laser light L modulated according to image information (time-series digital pixel signal), and scans the charged photosensitive drum 131 with the laser light L to thereby form an electrostatic latent image on the photosensitive drum 131. The laser scanner unit 120 outputs the laser light L based on image data (image information) obtained by the reader unit 102 that reads an image of an original or based on image data received from an external apparatus, such as a personal computer, via a network.

The developing device 140 includes a developing roller 141 and develops an electrostatic latent image on the photosensitive drum 131 with toner supplied (replenished) from a toner replenishment unit 150 which includes a toner bottle T, to thereby form a toner image. To form the toner image, toner corresponding to the image data is discharged from the developing device 140. The toner image formed on the photosensitive drum 131 is moved to the transfer nip in accordance with rotation of the photosensitive drum 131. A transfer bias of a polarity opposite to the polarity of the photosensitive drum 131 is applied to the transfer roller 133, whereby the toner image on the photosensitive drum 131 is transferred onto a surface of the recording sheet P at the transfer nip.

The recording sheet P having the toner image transferred thereon in the image forming section is conveyed into a fixing device 160. The fixing device 160 applies heat and pressure to the recording sheet P using a fixing heater and a pressure roller to thereby fix the toner image on the recording sheet P. The recording sheet P on which the image has been thus formed is discharged, after passing the fixing device 160, onto a discharge tray 171 outside the apparatus by a discharge roller 170.

Further, in a case where double-sided printing is performed on the recording sheet P, the recording sheet P on a first side of which image formation has been finished passes the position of an inversion flapper 181 and is then conveyed in an opposite direction by the discharge roller 170 and guided to an inversion conveying path 180 by the inversion flapper 181. The recording sheet P having been guided to the inversion conveying path 180 is conveyed to the position of the registration roller pair 115 again by inversion section conveying rollers 182 and 183. At this time, the first side and a second side of the recording sheet P are inverted from when the image forming operation was performed on the first side. Then, image formation is performed on the second side of the recording sheet P similarly to the above-mentioned image formation on the first side, and then the recording sheet P is discharged onto the discharge tray 171.

Figure 2:
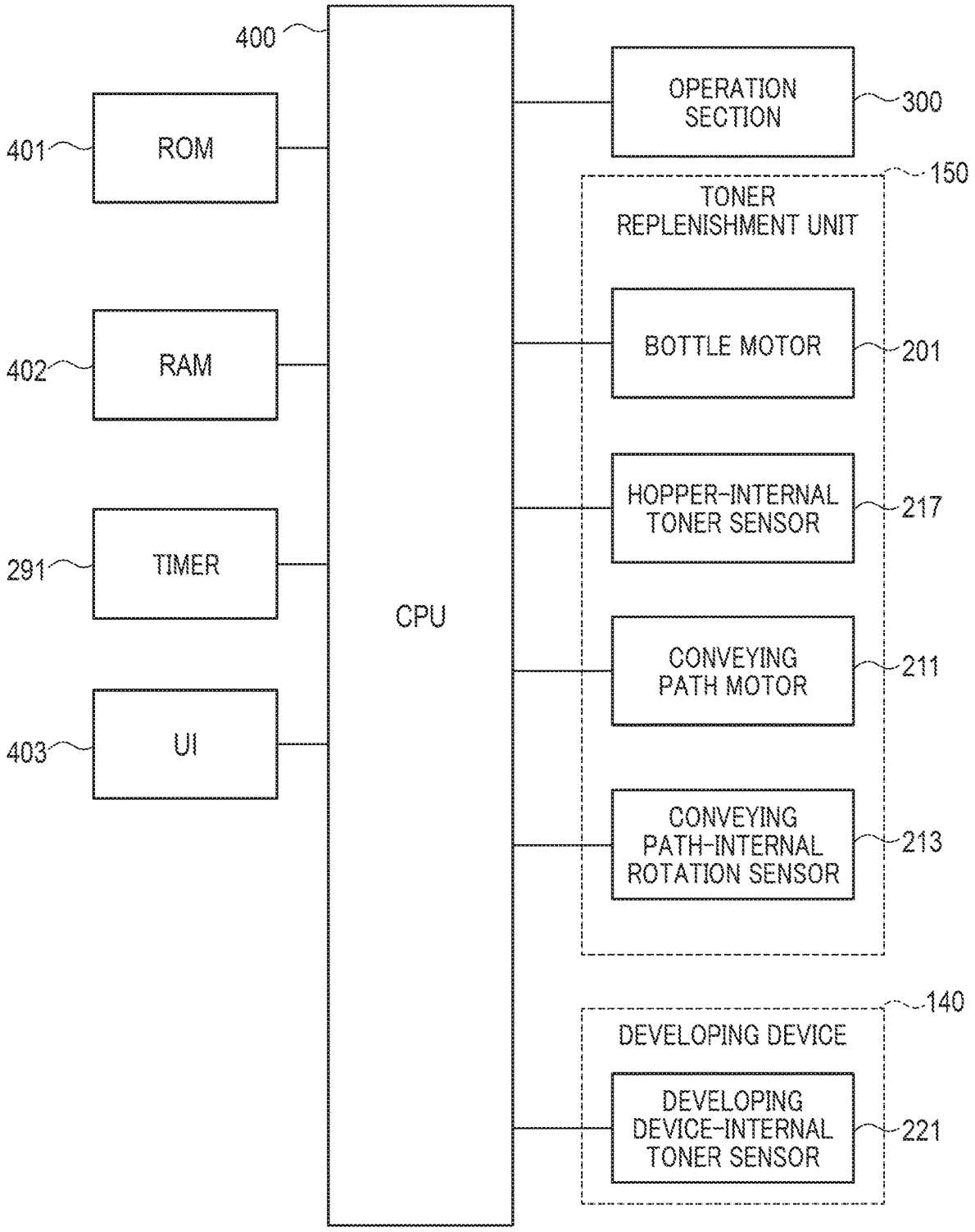
FIG. 2 is a control block diagram of the image forming apparatus.

FIG. 2 is a control block diagram of the image forming apparatus 100. The image forming apparatus 100 includes a CPU 400, a ROM 401, a RAM 402, a timer 291, a UI (user interface) 403, and an operation section 300. The UI 403 includes e.g. a display.

The ROM 401 stores control programs for controlling the overall operation of the image forming apparatus 100. The RAM 402 is a volatile storage device (memory) which is used as a work area for the CPU 400 and is used to temporarily store various data, such as image data. The CPU 400 controls the overall operation of the image forming apparatus 100 by loading the control programs stored in the ROM 401 into the RAM 402, and executing the loaded programs. The CPU 400 controls the operation of the toner replenishment unit 150 by controlling the operations of a bottle motor 201 and a conveying path motor 211. In the toner replenishment unit 150, there are arranged a hopper-internal toner sensor 217 (second detection unit), a conveying path-internal rotation sensor 213 (first detection unit), and a developing device-internal toner sensor 221. Signals output from these sensors 217, 213, and 221 are input to the CPU 400.

Figure 3:
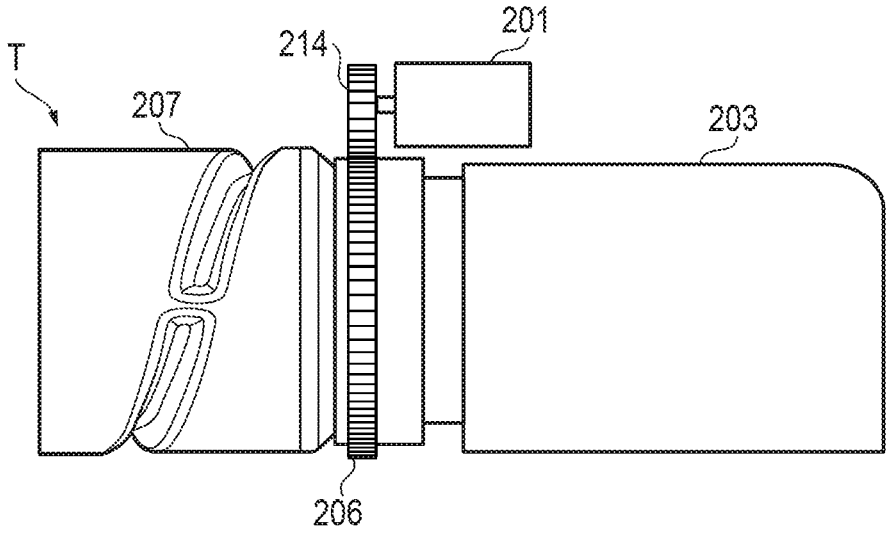
FIG. 3 is a view of the appearance of a toner bottle.

FIG. 3 is a view of the appearance of the toner bottle T. The toner bottle T is used in a state attached to an attachment section 220 of the toner replenishment unit 150, as described hereinafter with reference to FIG. 4. The toner bottle T is removable from the attachment section 220 and is replaced by a user or a service person. The toner bottle T is a toner container for storing toner used for development by the developing device 140. As shown in FIG. 3, the toner bottle T includes a cap part 203, a bottle storage part 207, a drive transmission section 206 to which a rotational driving force is transmitted via a drive gear train 214 from the bottle motor 201, and a discharge port (not shown) from which toner is discharged.

Figure 4:
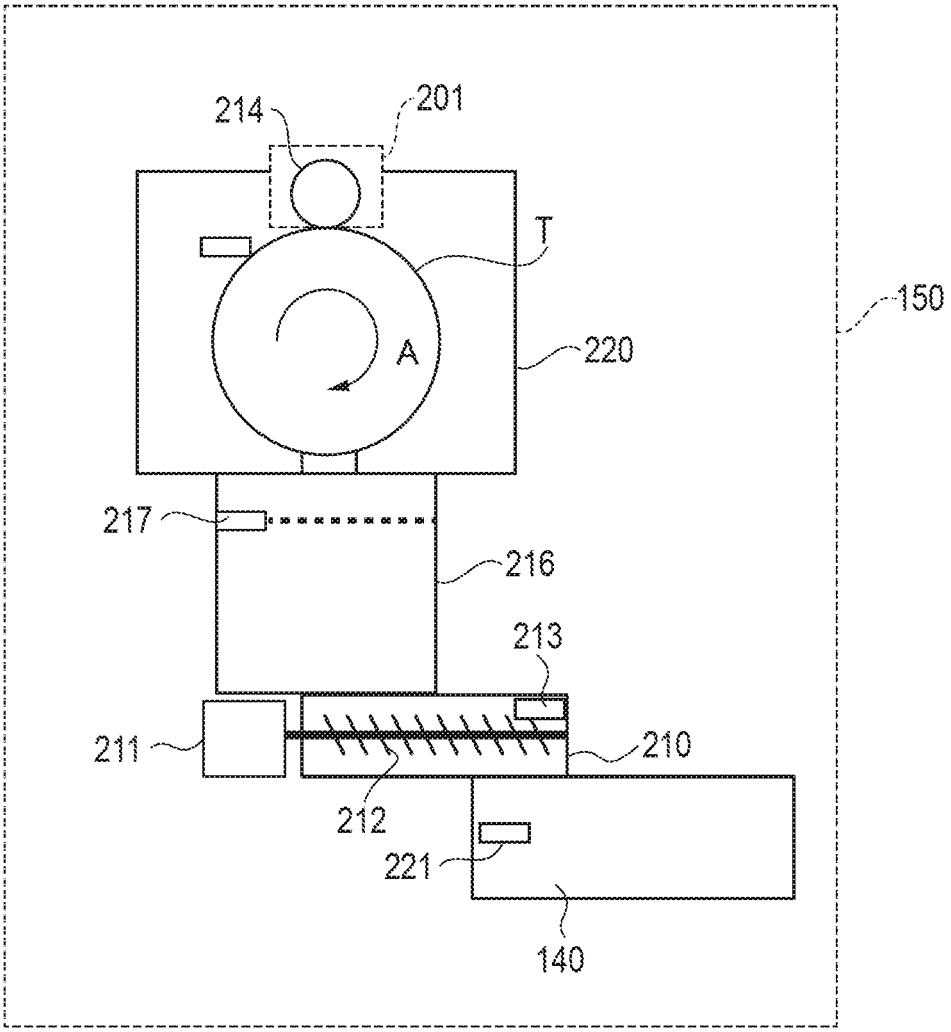
FIG. 4 is a schematic view showing the construction of a toner replenishment unit.

FIG. 4 is a schematic view showing the construction of the toner replenishment unit 150. The toner replenishment unit 150 includes the attachment section 220, the toner bottle T, the bottle motor 201, a hopper 216, a toner conveying path 210, a screw 212, and the conveying path motor 211. The toner bottle T, which is filled with toner in advance, can be attached to the attachment section 220 of the toner replenishment unit 150 e.g. by a user. The hopper 216 as a container plays the role of a buffer for temporarily storing toner discharged from the toner bottle T. The screw 212 as a conveying unit is disposed within the toner conveying path 210. The toner conveying path 210 is provided between the hopper 216 and the developing device 140, and conveys toner stored in the hopper 216 to the developing device 140 by rotating the screw 212.

The hopper-internal toner sensor 217 for detecting presence/absence of toner in the hopper 216 is provided in the hopper 216. The CPU 400 controls the toner bottle T so as to cause toner to be stored in the hopper 216 up to a boundary face at which the hopper-internal toner sensor 217 is disposed. Details of a method of detecting presence/absence of toner using the hopper-internal toner sensor 217 will be described hereinafter with reference to FIGS. 5A to 5D. The drive transmission section 206 of the toner bottle T receives a rotational drive force via a drive gear train 214 from the bottle motor 201. The bottle motor 201 drives the drive transmission section 206 for rotation, whereby the toner bottle T is rotated in a direction indicated by an arrow A in FIG. 4. When the toner bottle T is rotated, toner is discharged from the inside of the toner bottle T and flows into the hopper 216. The toner stored in the hopper 216 flows into the toner conveying path 210.

A rotational shaft of the screw 212 within the toner conveying path 210 is connected to the conveying path motor 211 via a drive gear train (not shown). A rotational drive force is applied from the conveying path motor 211 to the screw 212 via the drive gear train. The screw 212 conveys toner flowing into the toner conveying path 210 in one direction (from left to right, as viewed in FIG. 4) by its rotation. The toner conveyed through the toner conveying path 210 is replenished to the developing device 140 from an end portion of the toner conveying path 210. Further, the conveying path-internal rotation sensor 213 for detecting rotation of the screw 212 is provided in the toner conveying path 210. The CPU 400 determines whether or not the screw 212 is normally rotated based on the output of the conveying path-internal rotation sensor 213. Inside the developing device 140, the developing device-internal toner sensor 221 for detecting presence/absence of toner in the developing device 140 is provided.

FIGS. 5A to 5C are conceptual views showing states of detection of toner in the toner conveying path 210 and the developing device 140 by the hopper-internal toner sensor 217 and the developing device-internal toner sensor 221. FIG. 5D is a diagram showing a relationship between the sensor output value and the amount of toner in a case where a predetermined voltage is applied to each sensor.

The hopper-internal toner sensor 217 and the developing device-internal toner sensor 221 are both magnetic permeability sensors. FIGS. 5A to 5C schematically show a state in which the amount of toner containing magnetic material is small (state (a)), a state in which the amount of toner is normal (state (b)), and a state in which the amount of toner is large (state (c)), respectively. When a predetermined voltage is applied to the hopper-internal toner sensor 217 and the developing device-internal toner sensor 221, the output value of each sensor increases in proportion to increase in the toner amount, as shown in FIG. 5D.

Further, the CPU 400 uses different control parameters based on sensor output values in a manner adapted to respective usages of the toner sensors 217 and 221. For example, it is necessary to keep the toner density in the developing device 140 constant, and hence the CPU 400 directly uses the sensor output value of the developing device-internal toner sensor 221 as a control parameter. On the other hand, to store a first predetermined amount of toner in the hopper 216, it is only required to determine whether or not there is a corresponding amount of toner. To this end, the CPU 400 compares the output of the hopper-internal toner sensor 217 with a binarization threshold value, and in a case where the output value is not smaller than the binarization threshold value, the CPU 400 acquires a signal indicating that toner is present (ON) as a detection result. On the other hand, in a case where the output value of the hopper-internal toner sensor 217 is smaller than the binarization threshold value, the CPU 400 acquires a signal indicating that toner is absent (OFF) as the detection result. In other words, the output of the toner sensor 217 is converted to ON if the toner amount in the hopper 216 is not smaller than the first predetermined amount, and to OFF if the toner amount in the hopper 216 is smaller than the first predetermined amount. The first predetermined amount corresponds to the position where the toner sensor 217 is disposed (boundary face). The CPU 400 uses the detection result thus obtained by the toner sensor 217 as a control parameter.

The CPU 400 acquires information on presence or absence of toner in the hopper 216 and the toner density in the developing device 140, by monitoring the output signals from the hopper-internal toner sensor 217 and the developing device-internal toner sensor 221 e.g. at intervals of 100 msec. Note that the above-mentioned method of determining presence/absence of toner is described, by way of example, but the configuration for detecting presence/absence of toner using a piezo sensor may be employed. The hopper-internal toner sensor 217 is not necessarily required to be configured to detect presence/absence of toner in the hopper 216, but may be configured to output a value corresponding to the amount of toner.

Figure 6A:
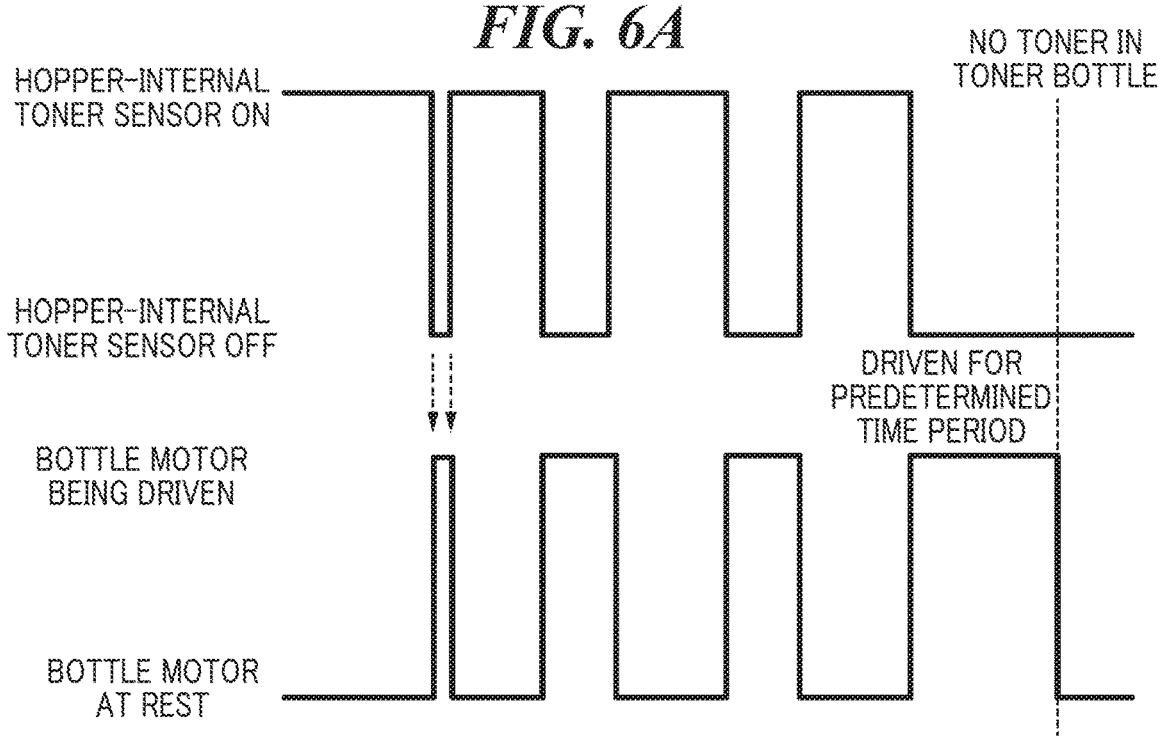
FIGS. 6A and 6B are timing diagrams of a sequence for replenishing toner from the toner bottle to a hopper, and a sequence for replenishing toner from the hopper to the developing device, respectively.

Next, a sequence for replenishing toner from the toner bottle T to the hopper 216 and a sequence for replenishing toner from the hopper 216 to the developing device 140 will be described with reference to FIGS. 6A and 6B. FIG. 6A is a timing diagram of the sequence for replenishing toner from the toner bottle T to the hopper 216.

When the image forming operation is being performed, toner corresponding to image data is discharged from the developing device 140. With this operation, when the toner density in the developing device 140 is lowered, toner is replenished from the hopper 216 to the developing device 140 through the toner conveying path 210 (see FIG. 4). As toner replenishment from the hopper 216 to the developing device 140 is repeated, in due time, it is determined by the hopper-internal toner sensor 217 in the hopper 216 that toner is absent in the hopper 216. When it is determined that toner is absent in the hopper 216, the CPU 400 controls the bottle motor 201 to rotate the toner bottle T. This causes toner to be replenished from the toner bottle T to the hopper 216. Then, in due time, it is determined by the hopper-internal toner sensor 217 that toner is present in the hopper 216. Therefore, the CPU 400 controls toner replenishment such that the toner density in the developing device 140 is kept constant and the amount of toner in the hopper 216 is kept constant.

Incidentally, when the amount of toner in the toner bottle T (in the toner container) becomes smaller than a second predetermined amount, even when the toner bottle T is rotated, toner is no longer replenished to the hopper 216. Therefore, as shown in FIG. 6A, even when the toner bottle T is rotated for a certain time period, the hopper-internal toner sensor 217 does not detect presence of toner (does not output a detection result indicating that toner is present), and hence the CPU 400 determines that the toner bottle T is empty (bottle toner is absent). The fact that the toner bottle T is empty means that the amount of toner in the tonner bottle T is smaller than the second predetermined amount. Note that even when it is determined that the toner bottle T is empty, so long as toner remains in the hopper 216, the image forming operation can be continued.

Figure 6B:
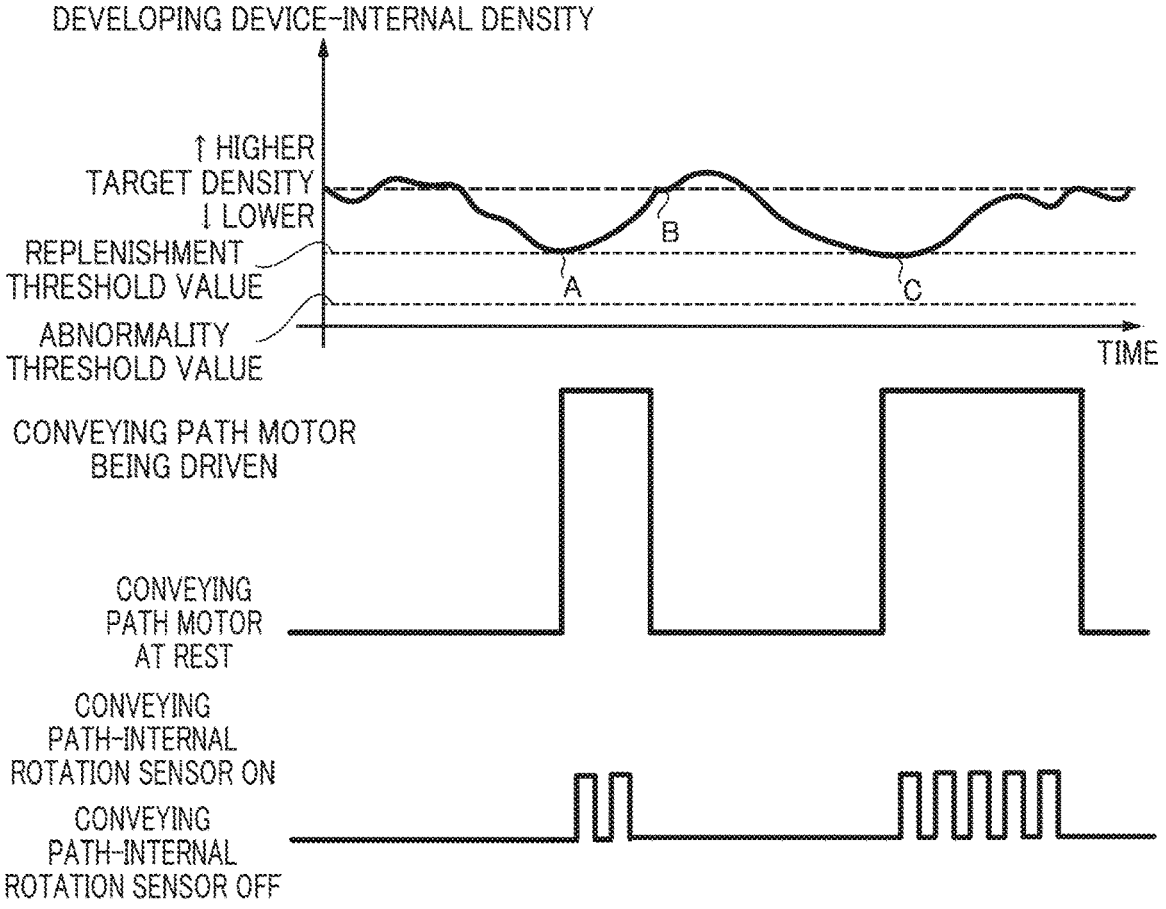

FIG. 6B is the sequence for replenishing toner from the hopper 216 to the developing device 140. Normally, the toner density in the developing device 140 is controlled by the CPU 400 such that it becomes equal to a fixed target density, as shown in FIG. 6B. As toner corresponding to image data is discharged from the developing device 140 during the image forming operation, the toner density is continuously lowered. To keep the toner density in the developing device 140 at the fixed target density, the CPU 400 monitors the output value of the developing device-internal toner sensor 221. In a case where the toner density becomes lower than a replenishment threshold value (as indicated at positions A and C), the CPU 400 controls the conveying path motor 211 to rotate the screw 212. Then, when the toner density reaches the target density (as indicated at a position B), the CPU 400 controls the conveying path motor 211 to stop rotation of the screw 212. Thereafter, the CPU 400 repeats this operation, whereby it is possible to keep the toner density at a density around the target density. Note that the CPU 400 may control the replenishment operation not only using the output value of the developing device-internal toner sensor 221, but also using e.g. image information used to form an image (such as pixel information).

Figure 7A:
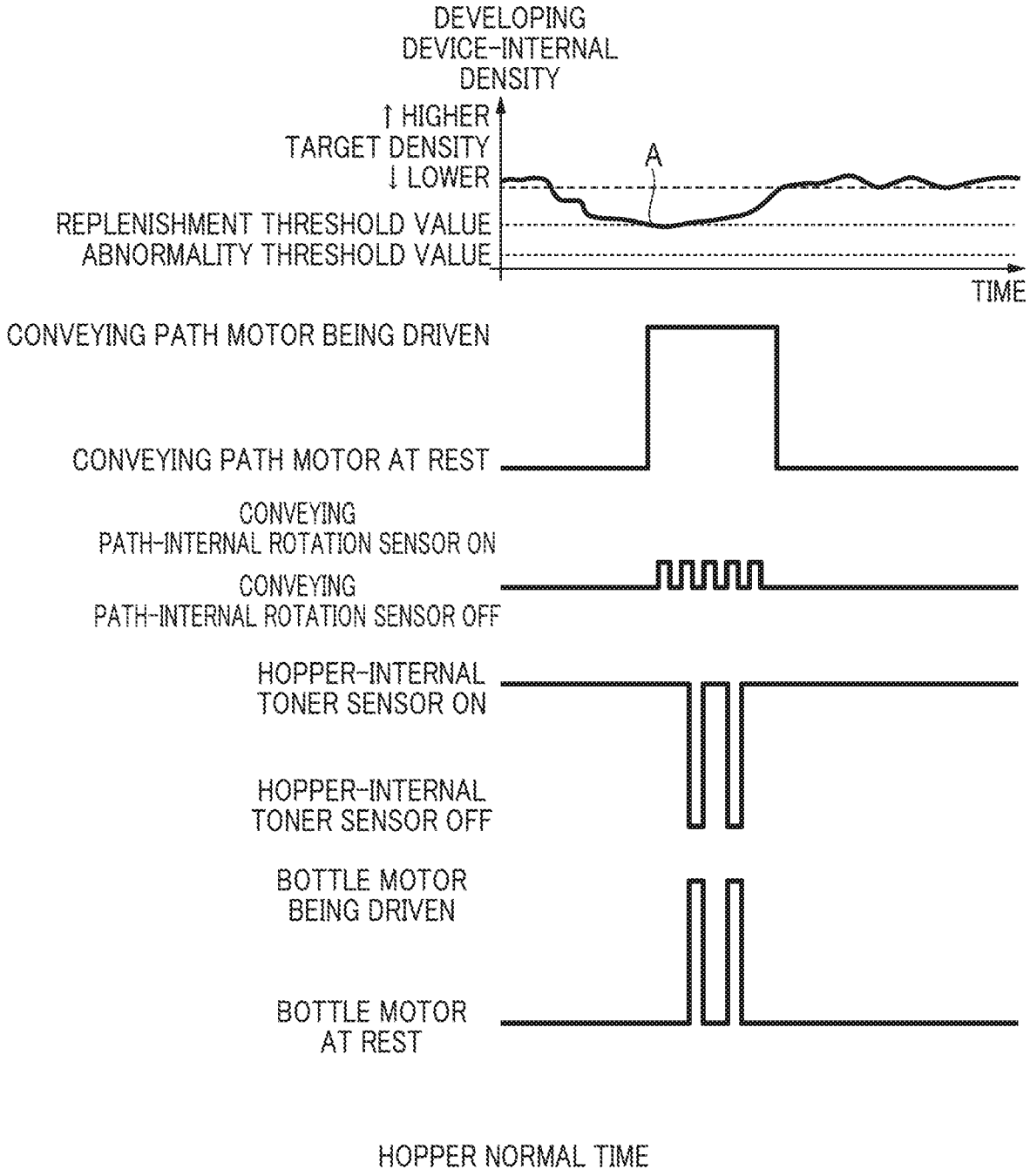
FIGS. 7A and 7B are timing diagrams showing the toner density in the developing device and operations of related components performed when the hopper is normal and when the hopper is abnormal, respectively.
Figure 7B:
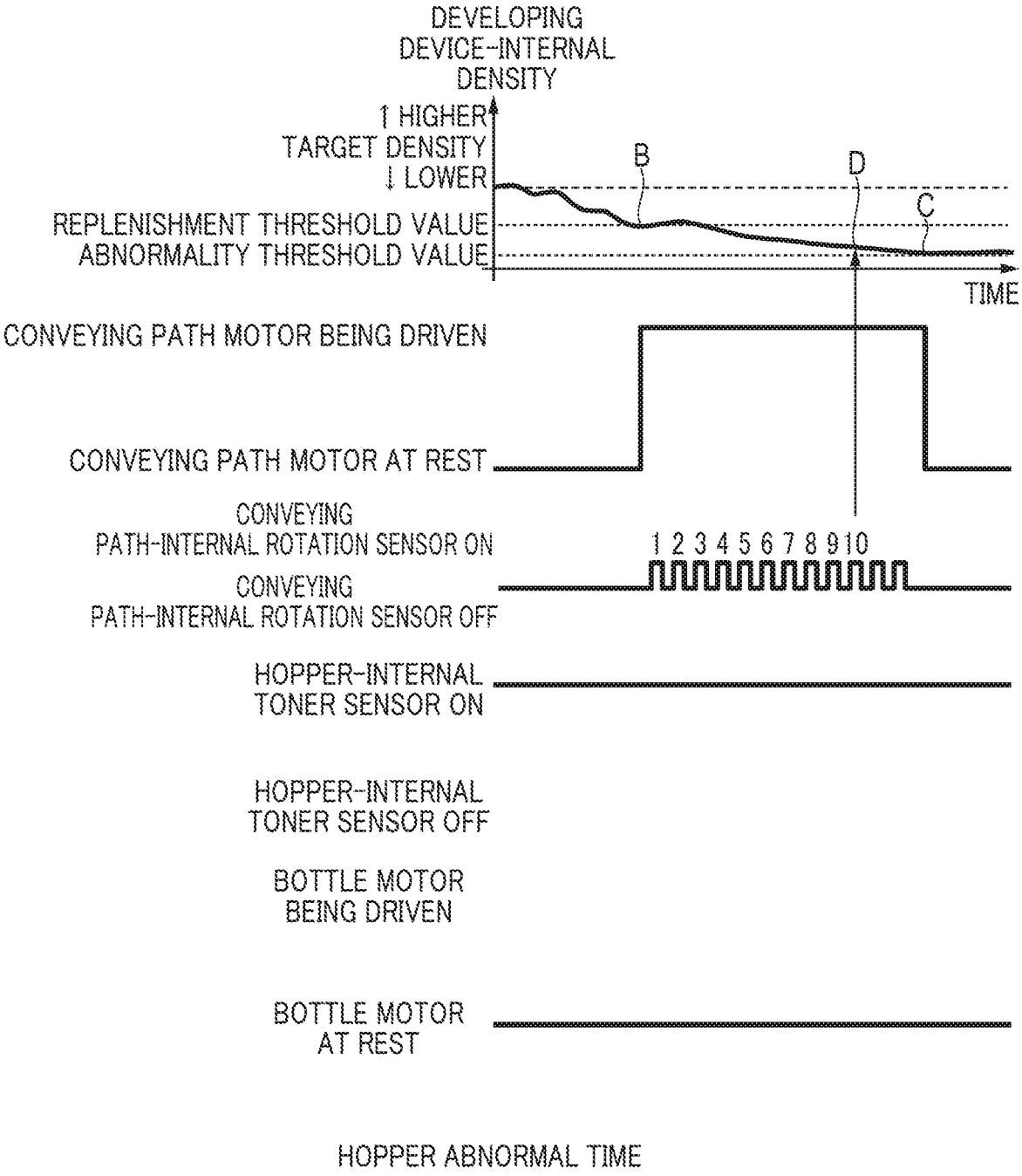

Next, a hopper normal state in which toner can be properly replenished from the hopper 216 to the developing device 140, and a hopper abnormal state in which toner cannot be properly replenished from the hopper 216 to the developing device 140 will be described with reference to FIGS. 7A and 7B. FIGS. 7A and 7B are timing diagrams showing the toner density in the developing device and the operations of related components performed when the hopper is normal and when an abnormality has occurred in the hopper, respectively. Note that hereinafter, the toner density in the developing device 140, detected by the developing device-internal toner sensor 221, is sometimes referred to as the "developing device-internal density".

In the normal state of the hopper, as shown in FIG. 7A, when the toner density in the developing device 140 is lowered to become lower than the replenishment threshold value (as indicated at a position A), toner replenishment from the hopper 216 to the developing device 140 is started. When the toner replenishment is started, since the screw 212 in the toner conveying path 210 starts to rotate, the output of the conveying path-internal rotation sensor 213 is changed to ON and OFF. Here, since the screw 212 is normally rotated, toner stored in the hopper 216 is replenished to the developing device 140 through the toner conveying path 210. As the amount of toner in the hopper 216 is reduced by this replenishment, in due time, the output of the hopper-internal toner sensor 217 in the hopper 216 is changed from ON (hopper toner is present) to OFF (hopper toner is absent). Further, driving of the bottle motor 201 is controlled according to the output of the hopper-internal toner sensor 217.

As described above, in a case where toner can be normally conveyed from the hopper 216 to the developing device 140, the conveying path-internal rotation sensor 213 reacts according to the driving of the conveying path motor 211 and the hopper-internal toner sensor 217 also reacts accordingly.

As the abnormal state of the hopper shown in FIG. 7B, there is assumed not only a case where the hopper-internal toner sensor 217 has failed and continues to output the ON signal (hopper toner is present), but also a case where the toner conveying path 210 has failed or is clogged with toner. In the abnormal state of the hopper, as shown in FIG. 7B, when the developing device-internal density becomes lower than the replenishment threshold value (as indicated at a position B), toner replenishment from the hopper 216 to the developing device 140 is started. When the toner replenishment is started, since the screw 212 in the toner conveying path 210 starts to rotate, the output of the conveying path-internal rotation sensor 213 is changed to ON and OFF.

Here, if there is no abnormality in the hopper, the output of the hopper-internal toner sensor 217 should be changed from ON to OFF. However, in the illustrated example in FIG. 7B, since the abnormality has occurred in the hopper, the output of the hopper-internal toner sensor 217 continues to indicate ON (hopper toner is present). Particularly, in a case where the hopper-internal toner sensor 217 has failed and continues to output the ON signal (hopper toner is present), since it is not determined that toner in the hopper 216 is insufficient, rotation of the bottle motor 201 is not started. Therefore, even though toner in the hopper 216 is insufficient in actuality, toner is not supplied from the toner bottle T to the hopper 216.

Therefore, in actuality, toner is not stored in the hopper 216 and is not supplied from the hopper 216 to the developing device 140, and hence the toner density in the developing device 140 is lowered. What is worse, if this state continues for a long time, the toner density is further lowered, so that the developing device-internal density can become lower than an abnormality threshold value, resulting in a situation in which it is determined that the developing device 140 is abnormal and the user is prompted to replace the developing device 140 (as indicated at a position C). Whichever of the above-mentioned causes may be responsible for the hopper abnormality state, the developing device 140 is not actually responsible for lowering of the developing device-internal density, but the incapability of normally discharging and conveying toner from the hopper 216 is responsible for it. To prevent the developing device 140 from being unnecessarily replaced, it is necessary to correctly identify the abnormal spot.

Figure 8:
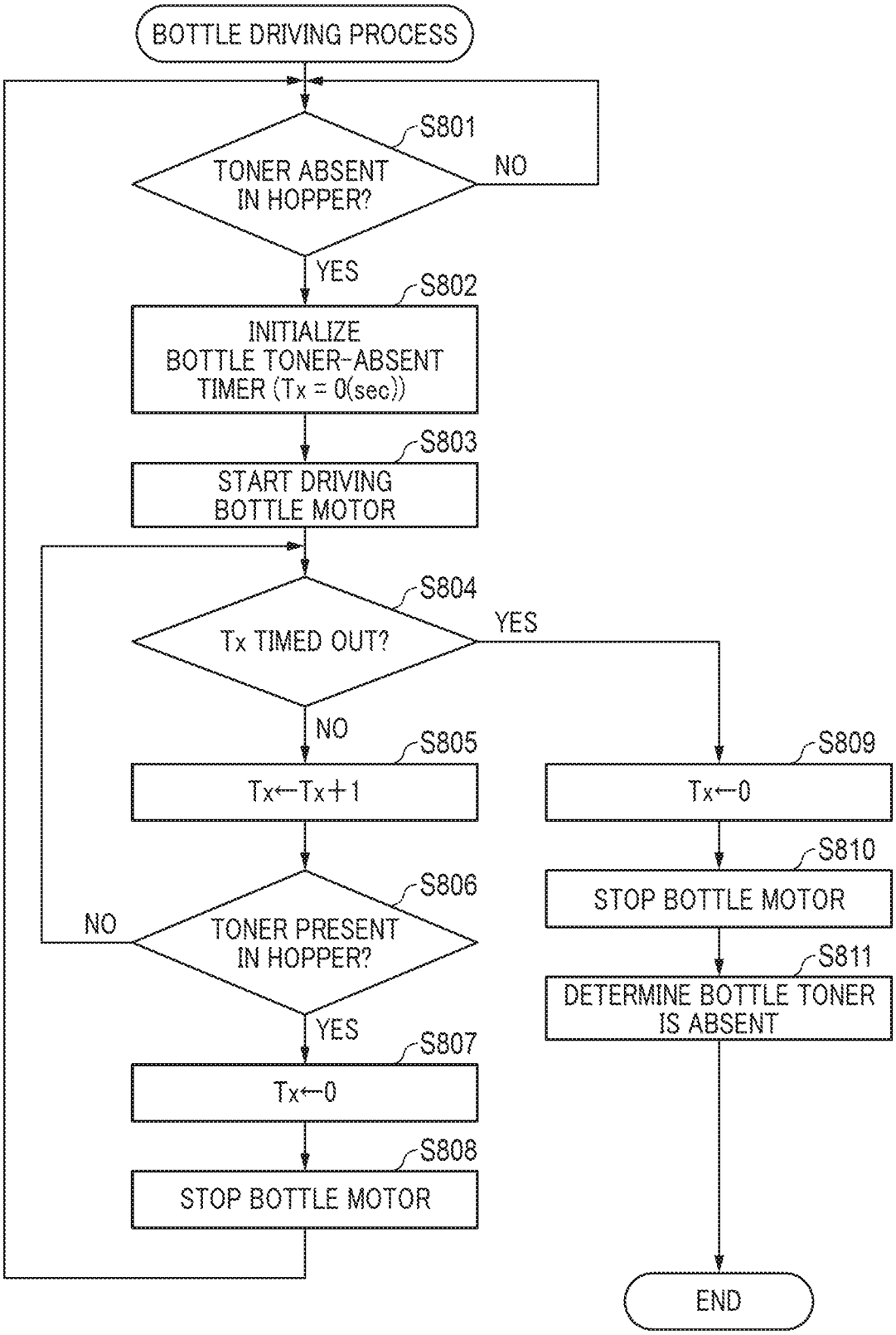
FIG. 8 is a flowchart of a bottle driving process.

Next, a process including the sequence for replenishing toner from the toner bottle T to the hopper 216 and an abnormality diagnosis sequence will be described with reference to FIG. 8. FIG. 8 is a flowchart of a bottle driving process. This bottle driving process is realized by the CPU 400 that loads a corresponding control program stored in the ROM 401 into the RAM 402 and executes the loaded program. This process is started when the image forming apparatus 100 is powered on or when the image forming apparatus 100 is recovered from an error state, and is executed irrespective of whether or not the print operation is being performed.

In a step S801, the CPU 400 waits until it is determined based on the output of the hopper-internal toner sensor 217 that toner is absent in the hopper 216. Then, if it is determined that toner is absent in the hopper 216 because the output of the hopper-internal toner sensor 217 is changed to OFF, the CPU 400 proceeds to a step S802.

In the step S802, the CPU 400 initializes a bottle toner-absent timer Tx to 0. Here, the bottle toner-absent timer Tx is a timer for determining that the amount of toner in the toner bottle T has become smaller than the second predetermined amount (referred to as "bottle toner is absent"). The value counted up by the bottle toner-absent timer Tx is used by converting the same to a time.

In a step S803, the CPU 400 starts to drive the bottle motor 201 for rotation. This causes the toner bottle T to be rotated. In a step S804, the CPU 400 determines whether or not the bottle toner-absent timer Tx has timed out. That is, the CPU 400 determines whether or not the value counted by the bottle toner-absent timer Tx has exceeded a time timeX (e.g. 40 sec). The time timeX is stored in advance in the RAM 402. If it is determined that the bottle toner-absent timer Tx has timed out because Tx>timeX holds, it is determined that the amount of toner in the toner bottle T becomes smaller than the second predetermined amount (bottle toner is absent), and hence the CPU 400 proceeds to a step S809. On the other hand, if it is determined that the bottle toner-absent timer Tx has not timed out, the CPU 400 proceeds to a step S805. In the step S805, the CPU 400 counts up the bottle toner-absent timer Tx using the timer 291.

In a step S806, the CPU 400 determines based on the output of the hopper-internal toner sensor 217 whether or not the hopper 216 is changed to a toner-present state. If the output of the hopper-internal toner sensor 217 is held at OFF and hence it is determined that toner is absent in the hopper 216, the CPU 400 returns to the step S804. On the other hand, if the output of the hopper-internal toner sensor 217 is changed to ON and hence it is determined that toner is present in the hopper 216, the CPU 400 proceeds to a step S807.

In the step S807, the CPU 400 initializes the bottle toner-absent timer Tx to 0. The CPU 400 stops driving of the bottle motor 201 in a step S808, and then, returns to the step S801.

In the step S809, the CPU 400 initializes the bottle toner-absent timer Tx to 0. The CPU 400 stops driving of the bottle motor 201 in a step S810, and determines that there is not toner in the toner bottle T and records this fact in the RAM 402 in a step S811, followed by terminating the process in FIG. 8.

After the step S811, the present process is not executed until the toner bottle T is replaced. According to the present process, it is possible to supply toner from the toner bottle T to the hopper 216 while monitoring the output value of the hopper-internal toner sensor 217 and thereby store the toner in the hopper 216 using the first predetermined amount as a target.

Figure 9:
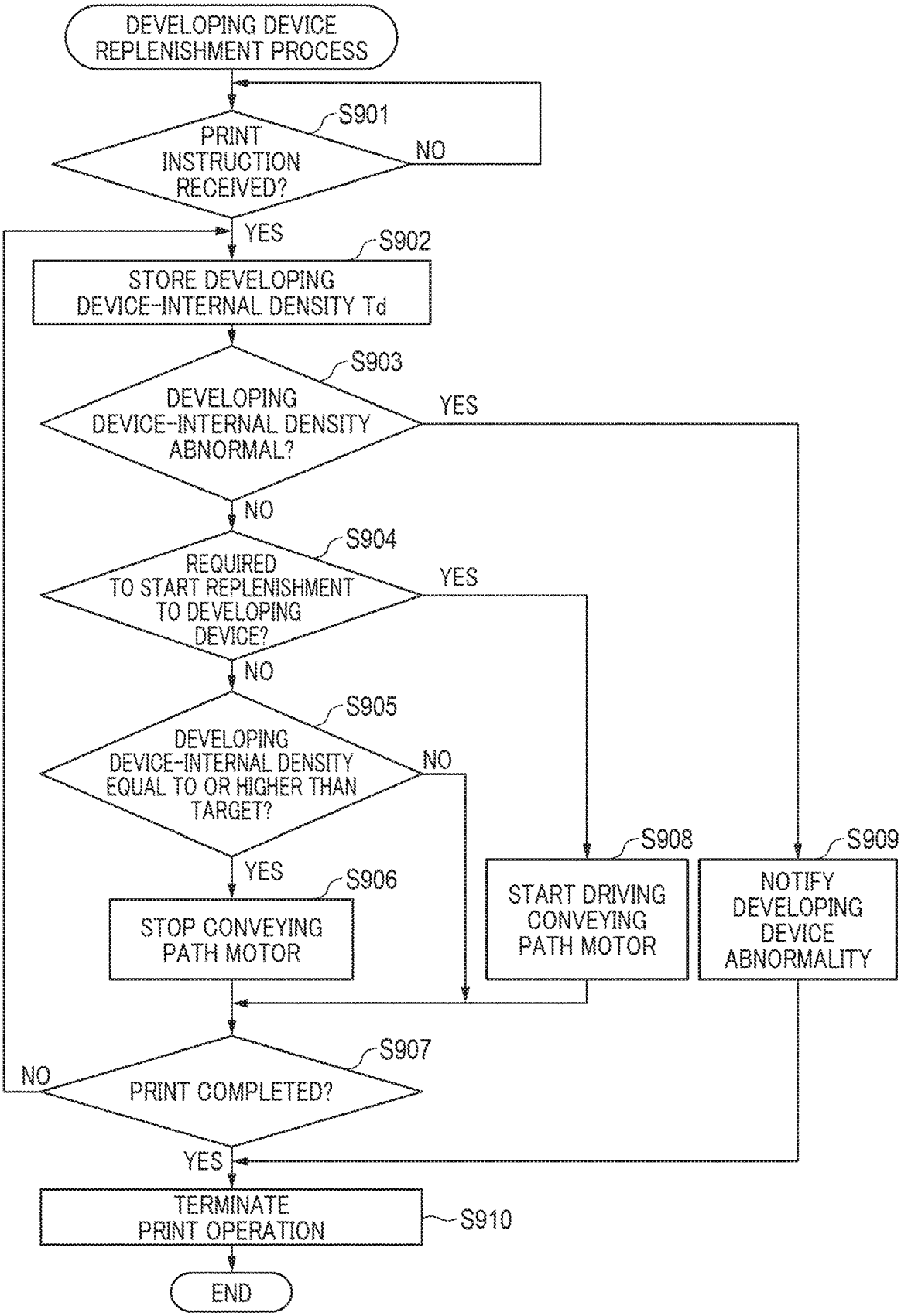
FIG. 9 is a flowchart of a developing device replenishment process.

Next, the sequence for replenishing toner from the hopper 216 to the developing device 140 (developing device replenishment process) will be described with reference to FIG. 9. FIG. 9 is a flowchart of the developing device replenishment process. This process is realized by the CPU 400 that loads a corresponding control program stored in the ROM 401 into the RAM 402 and executes the loaded program. This process is started when the image forming apparatus 100 is powered on. FIGS. 11A and 11B are diagrams each showing an example of display of an abnormality notification.

First, in a step S901, the CPU 400 waits until a print instruction is input. The print instruction is input by inputting a print job e.g. from an external apparatus (such as a computer, a server, and a scanner). Then, when the print instruction is input, in a step S902, the CPU 400 stores the current detection result of the developing device-internal toner sensor 221, in the RAM 402, as the developing device-internal density Td.

In a step S903, the CPU 400 compares the developing device-internal density Td, stored in the step S902, and the abnormality threshold value, stored in advance in the RAM 402, and determines whether or not the density in the developing device has become abnormal (the developing device-internal density Td is lower than the abnormality threshold value). If the developing device density Td is lower than the abnormality threshold value, the CPU 400 proceeds to a step S909 to notify the user that the developing device 140 has become abnormal. In this notification, for example, a message to the effect that the developing device 140 has become abnormal is displayed on the display of the UI 403 (see FIG. 11A). This enables the user or service person to identify the failure spot and properly cope with the failure, with respect to the abnormality of the developing device 140. In this case, it is difficult to continue the print operation, and hence the CPU 400 terminates the print operation in a step S910, followed by terminating the process in FIG. 9.

On the other hand, if the developing device-internal density Td is not lower than the abnormality threshold value in the step S903, it is possible to continue the print operation, and hence the CPU 400 proceeds to a step S904. In the step S904, the CPU 400 compares the developing device-internal density Td and the replenishment threshold value, stored in advance in the RAM 402, and determines whether or not it is necessary to start replenishment of toner to the developing device 140 (the developing device-internal density Td is lower than the replenishment threshold value). If the developing device-internal density Td is lower than the replenishment threshold value, it is necessary to start replenishment of toner to the developing device 140, and hence in a step S908, the CPU 400 starts driving the conveying path motor 211. This causes toner to start to be replenished from the hopper 216 to the developing device 140. After that, the CPU 400 proceeds to a step S907.

On the other hand, if the developing device-internal density Td is not lower than the replenishment threshold value, the CPU 400 proceeds to a step S905. In the step S905, the CPU 400 compares the developing device-internal density Td and a target density threshold value, stored in advance in the RAM 402, and determines whether or not the developing device-internal density Td is higher than the target density threshold value. Then, if the developing device-internal density Td is not higher than the target density threshold value, it is necessary to continue replenishment of toner, and hence the CPU 400 directly proceeds to the step S907. On the other hand, if the developing device-internal density Td is higher than the target density threshold value, toner replenishment is no longer required, and hence the CPU 400 stops driving the conveying path motor 211 in a step S906, and then proceeds to the step S907.

In the step S907, the CPU 400 determines whether or not the instructed print process is completed. Then, if the instructed print process is not completed, the CPU 400 returns to the step S902. On the other hand, if the instructed print process is completed, the CPU 400 proceeds to the step S910. Note that if the toner replenishment operation is being performed when executing the step S910, to terminate all the processes associated with the print operation, the CPU 400 also stops driving the conveying path motor 211.

According to the present process, it is possible to supply toner from the hoper 216 to the developing device 140, and hold the toner density in the developing device 140 within a predetermined range while monitoring the output value of the developing device-internal toner sensor 221.

Figure 10:
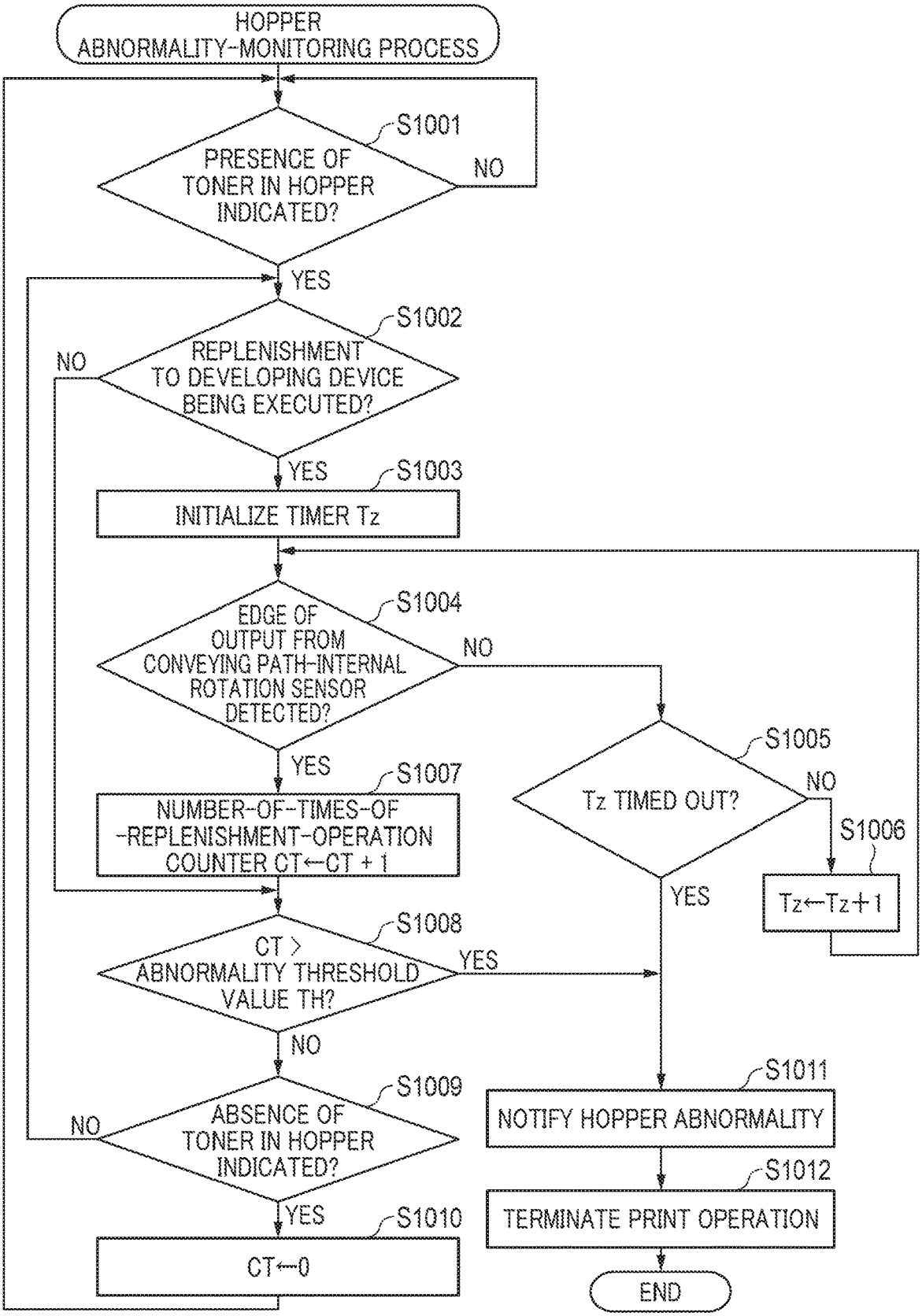
FIG. 10 is a flowchart of a hopper abnormality-monitoring process.

Next, FIG. 10 is a flowchart of a hopper abnormality-monitoring process. This process is realized by the CPU 400 that loads a corresponding control program stored in the ROM 401 into the RAM 402 and executes the loaded program. This process is started when the image forming apparatus 100 is powered on. In the process in FIG. 10, the CPU 400 corresponds to a determination unit of the present invention.

In a step S1001, the CPU 400 waits until the output of the hopper-internal toner sensor 217 indicates that toner is present in the hopper 216 (changed to ON). If the output of the hopper-internal toner sensor 217 indicates that toner is present in the hopper 216, in a step S1002, the CPU 400 determines whether or not toner is being replenished from the hopper 216 to the developing device 140. This is determined, for example, based on whether or not the CPU 400 controls to drive the conveying path motor 211. Then, if toner is not being replenished from the hopper 216 to the developing device 140, the screw 212 is not rotated, and hence the CPU 400 proceeds to a step S1008. On the other hand, if toner is being replenished from the hopper 216 to the developing device 140, the CPU 400 proceeds to a step S1003.

The step S1003 and steps S1004 to S1006 are steps for determining whether or not a state of detecting no edge of the output of the conveying path-internal rotation sensor 213 has continued for more than a predetermined time period (e.g. 1 sec). First, in the step S1003, the CPU 400 initializes a sensor output edge timer Tz to 0, which is used for determining whether or not the screw 212 in the toner conveying path 210 is normally rotating. In the step S1004, the CPU 400 determines whether or not an edge of the output of the conveying path-internal rotation sensor 213 is detected. Here, to make it possible to acquire the number of rotations of the screw 212, an output edge to be detected is set to a falling edge at which the output of the conveying path-internal rotation sensor 213 is changed from ON to OFF. However, a rising edge at which the output of the conveying path-internal rotation sensor 213 is changed from OFF to ON may be set as the edge to be detected.

Then, if no output edge from the conveying path-internal rotation sensor 213 is detected, the CPU 400 determines whether or not the sensor output edge timer Tz has timed out. The value of the timer Tz is used by converting the same to a time. Here, the timeout time (predetermined time period) of the sensor output edge timer Tz is set to 1 sec and this timeout time is stored in advance in the RAM 402. Then, if the sensor output edge timer Tz has not timed out, the CPU 400 counts up the sensor output edge timer Tz ($Tz \leftarrow Tz+1$) in the step S1006, and then returns to the step S1004.

On the other hand, if the sensor output edge timer Tz has timed out, it can be determined that there is a possibility that the screw 212 is not being normally rotated. Then, the CPU 400 proceeds to a step S1011. In this case, the CPU 400 determines that the hopper has become abnormal, and displays a message indicating the hopper 216 as a unit corresponding to the abnormal spot on the display of the UI 1403 (see FIG. 11B), and proceeds to a step S1012. Note that in a case where the process proceeds from the step S1005 to the step S1011, the CPU 400 determines that there is a possibility of failure of the conveying path-internal rotation sensor 213 or rotation failure of the screw 212. In the step S1012, the CPU 400 terminates the print operation, followed by terminating the process in FIG. 10.

If an edge of the output of the conveying path-internal rotation sensor 213 is detected in the step S1004, the CPU 400 counts up the value of a number-of-times-of-replenishment-operation counter CT, stored in the RAM 402, in a step S1007. The number-of-times-of-replenishment-operation counter CT is a counter for acquiring the number of rotations of the screw 212, and the initial value of the number-of-times-of-replenishment-operation counter CT is equal to 0. By executing the step S1007 et seq. on condition that the answer to the question of the step S1004 is positive (Yes), it is possible to acquire the number of rotations of the screw 212, assuming that rotation of the screw 212 can be normally detected. Therefore, it is possible to perform accurate determination in the step S1008.

Next, in the step S1008, the CPU 400 determines whether or not the value of the number-of-times-of-replenishment-operation counter CT has exceeded an abnormality determination threshold value TH (predetermined number of times) stored in advance in the RAM 402 ($CT>TH$). Note that although the abnormality determination threshold value TH is set to 10, this value can be empirically obtained and is not limited to this example. Here, to make it possible to determine that the hopper is abnormal before the toner density in the developing device 140 becomes lower than the abnormality threshold value (see FIGS. 7A and 7B), the abnormality determination threshold value TH should be set from the following viewpoints:

First, a time required until the number of times of detection of the edge of the output of the conveying path-internal rotation sensor 213 reaches the abnormality determination threshold value TH is set as a first required time. Further, assuming that toner is consumed at the highest consumption rate in the developing device 140, a time required until the toner density in the developing device 140 becomes lower than the abnormality threshold value after toner replenishment is required is set as a second required time. In other words, the second required time is the shortest estimated time required until the toner density in the developing device 140 becomes lower than the abnormality threshold value after the toner density in the developing device 140 becomes lower than the replenishment threshold value. Further, the abnormality determination threshold value TH is set such that the first required time is shorter than the second required time. For example, as shown in FIG. 7B, assuming that the abnormality determination threshold value TH is set to 10, it is possible to determine the abnormality of the hopper at a time point (as indicated at a position D) before the toner density in the developing device 140 becomes lower than the abnormality threshold value.

If it is determined in the step S1008 that the value of the number-of-times-of-replenishment-operation counter CT has not exceeded the abnormality determination threshold value TH, the CPU 400 proceeds to a step S1009. In the step S1009, the CPU 400 determines whether or not the output of the hopper-internal toner sensor 217 indicates that toner is absent in the hopper 216 (changed to OFF). If the output of the hopper-internal toner sensor 217 does not indicate that toner is absent in the hopper 216, since the state in which toner is present continues, the CPU 400 returns to the step S1002. On the other hand, if the output of the hopper-internal toner sensor 217 indicates that toner is absent in the hopper 216, it can be determined that toner in the hopper 216 has been reduced since toner is being conveyed from the hopper 216 to the developing device 140. That is, in a case where the output of the hopper-internal toner sensor 217 is changed to OFF before CT>TH holds, it is possible to determine that toner is normally conveyed from the hopper 216 to the developing device 140. Then, in a step S1010, the CPU 400 clears the number-of-times-of-replenishment-operation counter CT to 0, and returns to the step S1001.

On the other hand, if it is determined in the step S1008 that the value of the number-of-times-of-replenishment-operation counter CT has exceeded the abnormality determination threshold value TH, it can be determined that there is a possibility that toner is not normally conveyed from the hopper 216 to the developing device 140, and hence the CPU 400 executes the step S1011. In this case, the CPU 400 displays a message indicating the hopper 216 as a unit corresponding to the abnormal spot on the display of the UI 1403 (see FIG. 11B).

Note that in a case where the process proceeds from the step S1008 to the step S1011, the CPU 400 determines that there is a possibility of occurrence of failure of the hopper-internal toner sensor 217, clogging of the toner conveying path 210 with toner, or another failure in the toner conveying path 210. Note that the notification contents may be made different between the case where the process proceeds from the step S1005 to the step S1011 and the case where the process proceeds from the step S1008 to the step S1011 so as to notify the user of a possible failure and an abnormal spot, in more details.

Conventionally, in a case where an abnormality of the hopper 216 is not identified, there is a fear that the toner density in the developing device 140 becomes lower than the abnormality threshold value, as indicated at the position C in FIG. 7B, leading to the determination that the abnormality has occurred in the developing device 140. However, in the present embodiment, in a case where it can be determined that there is a possibility that toner is not conveyed from the hopper 216 to the developing device 140, it can be determined that the hopper 216 is abnormal before the developing device-internal density becomes lower than the abnormality threshold value (as indicated at the position D). This makes it possible to prompt a user or a service person to replace the hopper 216 without causing the user or the service person to unnecessarily replace the developing device 140.

Note that the manner of error notification is not limited to the error display, shown in FIGS. 11A and 11B, but the error may be notified using e.g. voice.

According to the present embodiment, in a state in which the hopper-internal toner sensor 217 has detected presence of toner in the hopper 216, it is determined based on the acquired number of rotations of the screw 212 whether or not there is a possibility that toner is not conveyed from the hopper 216 to the developing device 140. For example, the CPU 400 determines that there is a possibility that toner is not conveyed from the hopper 216 to the developing device 140 in a case where the value of the number-of-times-of-replenishment-operation counter CT (number of rotations) exceeds the abnormality determination threshold value TH (predetermined number of times). Therefore, it is unnecessary to use a sensor for detecting the toner density in the developing device 140 in determining whether or not there is a possibility that toner is not conveyed from the hopper 216 to the developing device 140. Therefore, even when a print job is being executed, it is possible to accurately determine whether or not there is a possibility that toner is not conveyed from the container (hopper 216) to the developing unit (developing device 140).

Particularly, since it is unnecessary to temporarily stop the print job, downtime of the print operation is not increased by the above-mentioned determination processing.

Further, by properly setting the abnormality determination threshold value TH as described above, it is possible to determine whether or not there is a possibility that toner is not conveyed from the hopper 216 to the developing device 140 before it is determined that a toner density abnormality has occurred in the developing device 140.

Further, in a case where the number of rotations of the screw 212 has exceeded the abnormality determination threshold value TH, it is determined that there is a possibility of occurrence of failure of the hopper-internal toner sensor 217, clogging of the toner conveying path 210 with toner, or another failure in the toner conveying path 210. Further, if a state of detecting no edge of the output of the conveying path-internal rotation sensor 213 has continued for more than a predetermined time period (e.g. 1 sec), it is determined that there has occurred failure of the in-conveying path rotation sensor 213 or rotation failure of the screw 212. This makes it possible to determine details of the abnormality of the hopper. Further, in a case where an abnormality in the hopper has occurred, this fact is notified, and hence it is possible to perform proper processing, such as replacement.

Further, when the state of detecting no edge of the output of the conveying path-internal rotation sensor 213 has continued for more than the predetermined time period (e.g. 1 sec), the CPU 400 does not perform determination of whether or not there is a possibility that toner is not conveyed from the hopper 216 to the developing device 140 based on the number of rotations. Therefore, it is possible to reduce erroneous determination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-002017 filed Jan. 9, 2019, which is hereby incorporated by reference herein in its entirety.

What is claimed is:

1. An image forming apparatus comprising:

a photosensitive member;

an exposure unit configured to expose the photosensitive member to form an electrostatic latent image;

a developing unit configured to develop the electrostatic latent image formed on the photosensitive member with toner;

a replenishment unit including:

a hopper in which the toner is stored;

a first toner sensor configured to detect toner stored in the hopper; and a rotational member that is rotated to replenish the toner from the hopper to the developing unit;

a rotation sensor configured to detect rotation of the rotational member;

a second toner sensor configured to detect a density of the toner in the developing unit;

a mount section on which a toner container is mounted, the toner container being configured to contain the toner;

a supplying unit configured to supply the toner from the toner container mounted on the mount section to the hopper; and a controller configured to:

control the supplying unit based on a detection result of the first toner sensor;

rotate the rotational member based on the detection result of the first toner sensor and a detection result of the second toner sensor;

acquire the number of rotations of the rotational member based on a detection result of the rotation sensor; and detect, in a case where the number of rotations, during a duration for which the rotation of the rotational member continues, reaches a predetermined number, an abnormality of the replenishment unit.

2. The image forming apparatus according to claim 1, further comprising a display configured to notify the abnormality of the replenishment unit.

3. The image forming apparatus according to claim 1, wherein the abnormality of the replenishment unit includes clogging of the hopper with the toner.

4. The image forming apparatus according to claim 1, wherein the abnormality of the replenishment unit includes an abnormality of the first toner sensor.

5. The image forming apparatus according to claim 1, wherein, in a case where the number of rotations during the duration for which the rotation of the rotational member continues is larger than the predetermined number, the controller inhibits an execution of an image forming operation in which the image forming apparatus forms an image.

6. The image forming apparatus according to claim 1, wherein the controller sets an initial number to the number of rotations during the duration, in a case where the detection result of the first toner sensor is changed from a first state in which the toner is detected to a second state in which the toner is not detected.

* * * * *